US011515070B2

(12) United States Patent
Hashimoto et al.

(10) Patent No.: US 11,515,070 B2
(45) Date of Patent: Nov. 29, 2022

(54) COIL COMPONENT

(71) Applicant: Murata Manufacturing Co., Ltd., Kyoto-fu (JP)

(72) Inventors: Ryota Hashimoto, Nagaokakyo (JP); Masashi Miyamoto, Nagaoka kyo (JP); Akio Igarashi, Nagaoka kyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 614 days.

(21) Appl. No.: 16/438,258

(22) Filed: Jun. 11, 2019

(65) Prior Publication Data

US 2019/0392973 A1 Dec. 26, 2019

(30) Foreign Application Priority Data

Jun. 21, 2018 (JP) ..... JP2018-118246

(51) Int. Cl.

| | |
|---|---|
| ***H01F 27/28*** | (2006.01) |
| ***H01F 17/04*** | (2006.01) |
| ***H01F 27/00*** | (2006.01) |
| ***H01F 27/24*** | (2006.01) |
| ***H01F 27/29*** | (2006.01) |

(52) U.S. Cl.

CPC ..... *H01F 17/045* (2013.01); *H01F 27/006* (2013.01); *H01F 27/24* (2013.01); *H01F 27/2823* (2013.01); *H01F 27/29* (2013.01); *H01F 2017/046* (2013.01); *H01F 2017/048* (2013.01)

(58) Field of Classification Search

CPC ..... H01F 17/045; H01F 27/006; H01F 27/24; H01F 27/2823; H01F 27/29; H01F 2017/046; H01F 2017/048; H01F 27/2828; H01F 27/327; H01F 27/28; H01F 27/306

See application file for complete search history.

(56) References Cited

U.S. PATENT DOCUMENTS 1,840,139 A * 1/1932 Turner ..... H01F 41/122 336/208
3,760,315 A * 9/1973 Hartmann ..... H01F 37/005 336/100
5,636,434 A * 6/1997 Okey ..... H01B 7/0208 427/116

(Continued)

FOREIGN PATENT DOCUMENTS

JP 2002-093635 A 3/2002
JP 2014-199904 A 10/2014

(Continued)

OTHER PUBLICATIONS

An Office Action; "Notice of Reasons for Refusal," mailed by the Japanese Patent Office dated Oct. 20, 2020, which corresponds to Japanese Patent Application No. 2018-118246 and is related to U.S. Appl. No. 16/438,258 with English language translation.

*Primary Examiner* — Mang Tin Bik Lian

(74) *Attorney, Agent, or Firm* — Studebaker & Brackett PC

(57) ABSTRACT

A coil component includes a first alignment winding region in which a second wire is continuously wound so as to have turns such that the turns of the second wire are aligned with turns of a first wire having the same ordinal number outside the first wire in a direction perpendicular to a central axis. The ordinal number is counted from the turn nearest to the first flange portion.

18 Claims, 13 Drawing Sheets

(56) References Cited

U.S. PATENT DOCUMENTS

| | | | | |
|---|---|---|---|---|
| 5,963,119 | A * | 10/1999 | Takeda | H01F 17/045 336/200 |
| 2010/0182115 | A1* | 7/2010 | Huang | H01F 17/045 336/83 |
| 2016/0133377 | A1* | 5/2016 | Takagi | H01F 27/29 29/605 |
| 2017/0025212 | A1 | 1/2017 | Jerez et al. | |
| 2017/0330672 | A1* | 11/2017 | Uchida | H01F 27/292 |
| 2018/0211756 | A1* | 7/2018 | Kuo | H01F 27/29 |
| 2019/0318866 | A1* | 10/2019 | Mikogami | H01F 27/2828 |

FOREIGN PATENT DOCUMENTS

| | | | |
|---|---|---|---|
| JP | 2015-230968 | A | 12/2015 |
| JP | 2017-508298 | A | 3/2017 |
| JP | 2017-204596 | A | 11/2017 |
| WO | 2017/061143 | A1 | 4/2017 |

* cited by examiner

COIL COMPONENT

CROSS-REFERENCE TO RELATED APPLICATION

This application claims benefit of priority to Japanese Patent Application No. 2018-118246, filed Jun. 21, 2018, the entire content of which is incorporated herein by reference.

BACKGROUND

Technical Field

The present disclosure relates to a coil component in which wires are wound around a winding core portion, and more particularly, to the winding form of the wires.

Background Art

As disclosed in, for example, Japanese Unexamined Patent Application Publication No. 2014-199904 and International Publication No. 2017/061143, a common mode choke coil, which is an example of a coil component, includes a drum-shaped core that includes a winding core portion, a first flange portion, and a second flange portion, a first wire and a second wire that are wound around the winding core portion, a first terminal electrode and a third terminal electrode that are disposed on the first flange portion, and a second terminal electrode and a fourth terminal electrode that are disposed on the second flange portion.

A first end of the first wire is connected to the first terminal electrode, and a second end thereof is connected to the second terminal electrode. A first end of the second wire is connected to the third terminal electrode, and a second end thereof is connected to the fourth terminal electrode.

The first wire and the second wire form two layers such that the first wire is wound inside the second wire, and the second wire is wound outside the first wire. The first wire is wound so as to be in contact with the circumferential surface of the winding core portion. The second wire is wound such that the turns thereof are outside the turns of the first wire having the same ordinal number.

In some schematic figures, the second wire is illustrated so as to be wound such that the turns thereof are located right above the turns of the first wire having the same ordinal number. In reality, however, a tensile force due to winding at this time causes the distance between the turns of the second wire outside the first wire to decrease to the minimum distance, and the turns of the second wire cannot remain right above the turns of the first wire having the same ordinal number and are fitted in a recessed portion formed between the adjacent turns of the first wire.

SUMMARY

In the case of the above actual winding form of the first wire and the second wire, the n-th turn of one of the first wire and the second wire is in contact with the n-th turn of the other and the (n−1)-th turn or the (n+1)-th turn of the other, and there is a large stray capacitance between the turns that are in contact with each other. The stray capacitance affects the electrical characteristics of a common mode choke coil. There is always a large stray capacitance between the n-th turn and the (n−1)-th turn of one of the first wire and the second wire, and there is always a large stray capacitance between the n-th turn and the (n+1)-th turn of the other. This results in asymmetry in the direction in which the stray capacitance occurs. Such asymmetry causes mode conversion between a common mode noise and a differential mode signal in the common mode choke coil.

The asymmetry in the direction in which the stray capacitance occurs can make a problem not only in the common mode choke coil but also in, for example, a transformer or a balun that includes a first wire and a second wire.

Thus, the present disclosure provides a coil component that can decrease the asymmetry in the direction in which the stray capacitance occurs.

According to preferred embodiments of the present disclosure, a coil component includes a drum-shaped core that includes a winding core portion extending along a central axis, a first flange portion that is disposed on a first end portion of the winding core portion in a direction of the central axis, and a second flange portion that is disposed on a second end portion of the winding core portion in the direction of the central axis. The coil component further includes a first terminal electrode and a third terminal electrode that are disposed on a bottom surface of the first flange portion that is to face a mounting substrate during mounting, a second terminal electrode and a fourth terminal electrode that are disposed on a bottom surface of the second flange portion that is to face the mounting substrate, a first wire that is wound around the winding core portion and that is electrically connected to the first terminal electrode and the second terminal electrode, and a second wire that is wound around the winding core portion and that is electrically connected to the third terminal electrode and the fourth terminal electrode.

The coil component includes a first alignment winding region in which the second wire is continuously wound so as to have turns such that the turns of the second wire are aligned with turns of the first wire having the same ordinal number outside the first wire in a direction perpendicular to the central axis. The ordinal number is counted from the turn nearest to the first flange portion.

In the coil component, the turns of the first wire and the turns of the second wire having the same ordinal number are aligned, and the distance between the different turns can be ensured. Accordingly, the stray capacitance that occurs between the different turns of the first wire and the second wire can be decreased, and the asymmetry in the direction in which the stray capacitance occurs can be decreased.

Other features, elements, characteristics and advantages of the present disclosure will become more apparent from the following detailed description of the present disclosure with reference to the attached drawings.

DETAILED DESCRIPTION

Embodiments will hereinafter be described with reference to the drawings. In different drawings, like components or components corresponding to each other are designated by like reference numbers, and a duplicated description is omitted in some cases.

Figure 1:
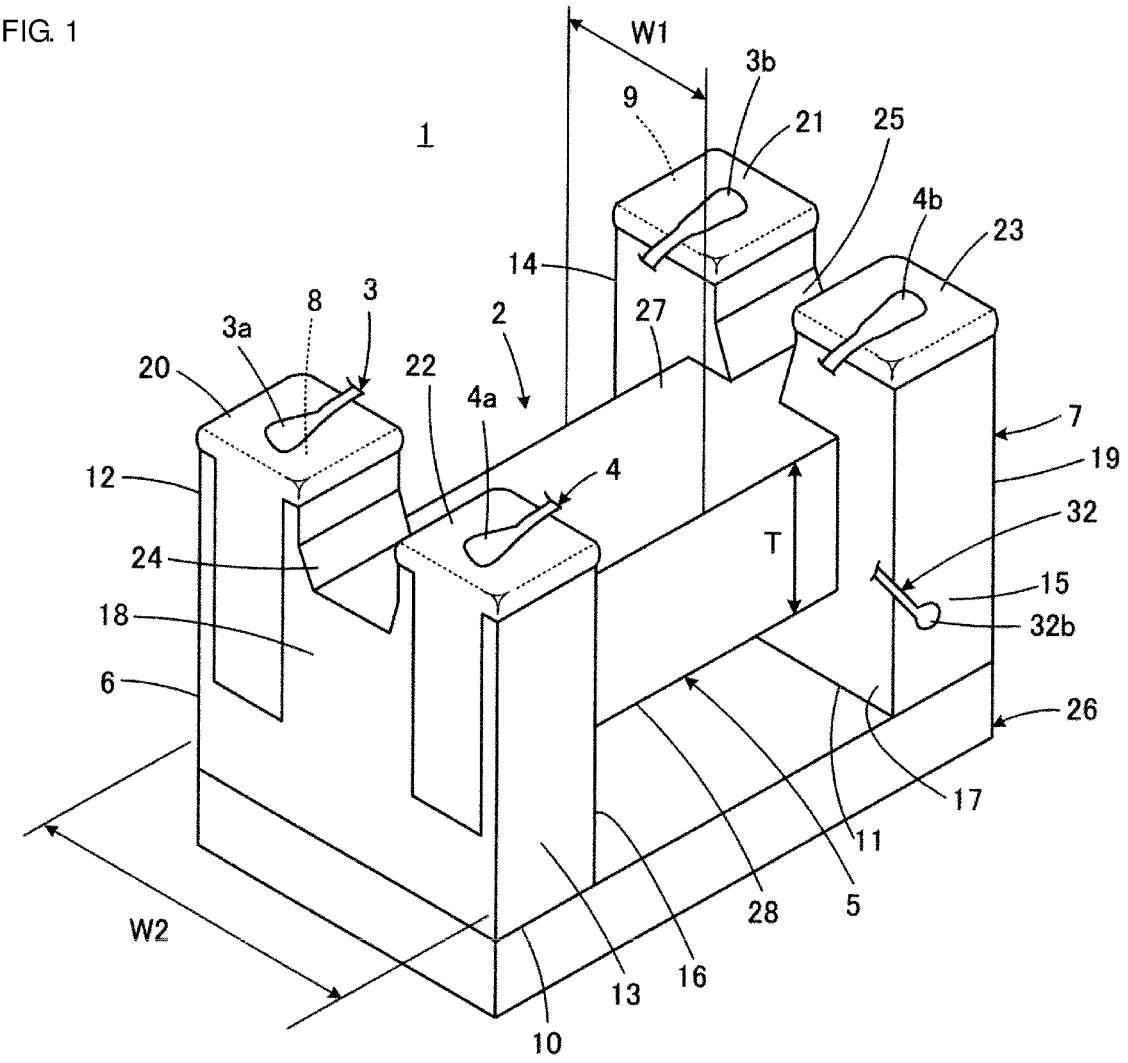
FIG. 1 is a perspective view of a coil component according to a first embodiment and illustrates the appearance thereof from a mounting surface side, where an illustration of principal parts of wires are omitted.

A coil component 1 according to a first embodiment will now be described with reference to mainly FIG. 1 and FIG. 2. In FIG. 1, the coil component 1 is illustrated with a mounting surface of the coil component 1 facing upward, and the mounting surface is to face a mounting substrate, not illustrated, during mounting. The coil component 1 illustrated forms, for example, a common mode choke coil.

A drum-shaped core 2 included in the coil component 1 includes a winding core portion 5 that extends along a central axis 5A, and two wires 3 and 4 are wound around the winding core portion 5. The drum-shaped core 2 also includes a first flange portion 6 that is disposed on a first end portion of the winding core portion 5 in the direction of the central axis 5A and a second flange portion 7 that is disposed on a second end portion of the winding core portion 5 that is opposite the first end portion in the direction of the central axis 5A. The drum-shaped core 2 is preferably composed of ferrite. The drum-shaped core 2 may be composed of a nonconductive material other than ferrite, for example, a non-magnetic material such as alumina or a resin that contains ferrite powder or magnetic metal powder.

When the drum-shaped core 2 is composed of ferrite, the drum-shaped core 2 can be manufactured in a manner in which ferrite powder is press-molded with a mold, a molded body obtained is fired, and a burr is removed after firing. When the drum-shaped core 2 is molded, a multistage press method may be used, that is, a punch mold for molding the flange portions 6 and 7 may be isolated from a punch mold for molding the winding core portion 5, or a single press method may be used, that is, the flange portions 6 and 7 and the winding core portion 5 may be molded together. Injection molding or 3D printer molding may be used to mold the drum-shaped core 2.

The winding core portion 5, the first flange portion 6, and the second flange portion 7 that are included in the drum-shaped core 2 have, for example, a substantially quadrangular prism shape having a substantially square sectional shape. Ridge line portions of the winding core portion 5 and the flange portions 6 and 7 having a substantially quadrangular prism shape are preferably round-chamfered. The sectional shape of the winding core portion 5, the first flange portion 6, and the second flange portion 7 may be a substantially polygonal shape such as a hexagon, a substantially circular shape, or a substantially ellipse shape, or a combination thereof, instead of a square.

The first flange portion 6 has a bottom surface 8 that is to face the mounting substrate during mounting, an upper surface 10 opposite the bottom surface 8, and an inner end surface 16, an outer end surface 18, a first side surface 12, and a second side surface 13 that extend in a direction perpendicular to the mounting substrate and the bottom surface 8. The inner end surface 16 faces in an inward direction toward the winding core portion 5. The outer end surface 18 faces away from the inner end surface 16 in an outward direction. The first side surface 12 and the second side surface 13 do not face in the inward direction or the outward direction but face away from each other in a side direction.

As with the first flange portion 6, the second flange portion 7 has a bottom surface 9 that is to face the mounting substrate during mounting, an upper surface 11 opposite the bottom surface 9, an inner end surface 17, an outer end surface 19, a first side surface 14, and a second side surface 15 that extend in a direction perpendicular to the mounting substrate or the bottom surface 9. The inner end surface 17 faces in the inward direction toward the winding core portion 5. The outer end surface 19 faces away from the inner end surface 17 in the outward direction. The first side surface 14 and the second side surface 15 do not face in the inward direction or the outward direction but face away from each other in the side direction.

A first terminal electrode 20 and a third terminal electrode 22 are disposed on the bottom surface 8 of the first flange portion 6. A second terminal electrode 21 and a fourth terminal electrode 23 are disposed on the bottom surface 9 of the second flange portion 7. A recessed portion 24 extends from the bottom surface 8 of the first flange portion 6 and isolates the first terminal electrode 20 and the third terminal electrode 22 from each other. A recessed portion 25 extends from the bottom surface 9 of the second flange portion 7 and isolates the second terminal electrode 21 and the fourth terminal electrode 23 from each other.

As inferred from the form of the first terminal electrode 20 and the third terminal electrode 22 illustrated in FIG. 1, each of the terminal electrodes 20 to 23 includes a bottom surface electrode portion extending along the bottom surface 8 or 9 of the flange portion 6 or 7, an end surface electrode portion extending along the outer end surface 18 or 19 of the flange portion 6 or 7, and a plating film that continuously covers the bottom surface electrode portion and the end surface electrode portion.

Each bottom surface electrode portion is a baked thick film that is formed, for example, by preparing a conductive paste that contains Ag powder serving as a conductive component and that contains Si serving as a glass component that is brought into close contact with the flange portions 6 and 7, applying the conductive paste to the bottom surfaces 8 and 9 of the flange portions 6 and 7 by using a dipping method, and subsequently baking the conductive paste. The bottom surface electrode portion extends not only over the bottom surface 8 or 9 but also to parts of surfaces adjacent to the bottom surface 8 or 9 from the bottom surface 8 or 9.

Each end surface electrode portion is composed of a sputtering thin film that contains, for example, Ni, Cr, and Cu. More specifically, the end surface electrode portion preferably includes a first metal layer that contains Ni and Cr and a second metal layer that is formed thereon and that contains Ni and Cu.

The outermost surface of each of the terminal electrodes 20 to 23 is composed of the plating film. The plating film continuously covers the bottom surface electrode portion and the end surface electrode portion. For example, the plating film includes a Ni plating layer and a Sn plating layer thereon. A Cu plating layer may be formed above or below the Ni plating layer. An Au plating layer or a Pd plating layer may be formed instead of the Sn plating layer.

The terminal electrodes 20 to 23 do not necessarily include the end surface electrode portion extending along the outer end surface 18 or 19 of the flange portion 6 or 7.

The terminal electrodes 20 to 23 may be formed by attaching metal plate members obtained by processing plates each composed of a conductive metal to the flange portions 6 and 7 with an adhesive. In this case, each metal plate member is obtained, for example, by forming a Ni plating layer and a Sn plating layer in this order on a Cu plate, and each of the terminal electrodes 20 to 23 is obtained by punching the metal plate member.

The coil component 1 may further include a plate core 26 extending over the upper surface 10 of the first flange portion 6 and the upper surface 11 of the second flange portion 7. As with the drum-shaped core 2, the plate core 26 is preferably composed of ferrite. The plate core 26 may be composed of a nonconductive material other than ferrite, for example, a non-magnetic material such as alumina or a resin that contains ferrite powder or magnetic metal powder.

When the plate core 26 is composed of ferrite, the plate core 26 can be manufactured in a manner in which ferrite powder is press-molded with a mold, a molded body obtained is fired, and a burr is removed after firing.

The plate core 26 adheres to the upper surface 10 of the first flange portion 6 and the upper surface 11 of the second flange portion 7 with an adhesive not illustrated. This enables the plate core 26 to form a closed magnetic circuit in cooperation with the drum-shaped core 2. Examples of the adhesive include an adhesive composed of an epoxy resin that contains a silica filler. An adhesive that contains no filler may be used to decrease gaps between the plate core 26 and the flange portions 6 and 7.

For example, the external dimensions of the drum-shaped core 2 are about 3.2 mm in length, about 2.5 mm in width, and about 1.7 mm in height. The dimension of the winding core portion 5 in a thickness direction T (direction perpendicular to the mounting substrate or the bottom surfaces 8 and 9; see FIG. 1) is preferably 1.0 mm or less, for example, about 0.6 mm. The distance from the bottom surfaces 8 and 9 of the flange portions 6 and 7 to a bottom surface 27 of the winding core portion 5 is preferably 0.50 mm or more in the perspective of a decrease in the stray capacitance, is preferably 1.50 mm or less because the height can be decreased (i.e., from 0.50 mm to 1.50 mm), and is, for example, about 0.70 mm.

The plate core 26 has a substantially rectangular cuboid shape. For example, the external dimensions thereof are about 3.3 mm in length, about 2.6 mm in width, and about 0.7 mm in height. The reason why the planer dimensions of the plate core 26 are larger than the above planer dimensions of the drum-shaped core 2 is that, even when the plate core 26 adheres to the drum-shaped core 2 with misalignment, an effect on the closed magnetic circuit due to the misalignment can be decreased. Such a directional relationship is not illustrated in FIG. 1. The height of the plate core 26 is preferably 0.3 mm or more to ensure a high impedance and is preferably 2.0 mm or less (i.e., from 0.3 mm to 2.0 mm) because the height can be decreased.

Regarding the dimension measured in a width direction that is parallel to the bottom surfaces 8 and 9 and that is perpendicular to the central axis 5A (see FIG. 2) of the winding core portion 5, that is, the dimension in the width direction, the dimension W1 (see FIG. 1) of the winding core portion 5 is preferably 1.0 mm or less. In the case where the dimension W1 of the winding core portion 5 in the width direction is decreased to 1.0 mm or less, a ratio of a winding region to the length of the first wire 3 and the fourth wire is decreased, and the difference in length between the first wire on the inside and the second wire 4 on the outside can be decreased in a state where the first wire 3 and the second wire 4 are wound, which will be described in detail later. Decreasing the thickness of the winding core portion 5 decreases the length of the first wire 3 and the second wire 4 and decreases the total stray capacitance that occurs between the first wire 3 and the second wire 4. Accordingly, the value of mode conversion characteristics can be decreased.

The dimension W1 of the winding core portion 5 in the width direction is preferably equal to or less than 40% of the dimension W2 (see FIG. 1) of the first flange portion 6 and the second flange portion 7 in the width direction. Also, in this case, the thickness of the winding core portion 5 is decreased, the difference in length between the first wire on the inside and the second wire 4 on the outside can be decreased in the state where the first wire 3 and the second wire 4 are wound, and the value of the mode conversion characteristics can be decreased, as with the above description.

Figure 3:
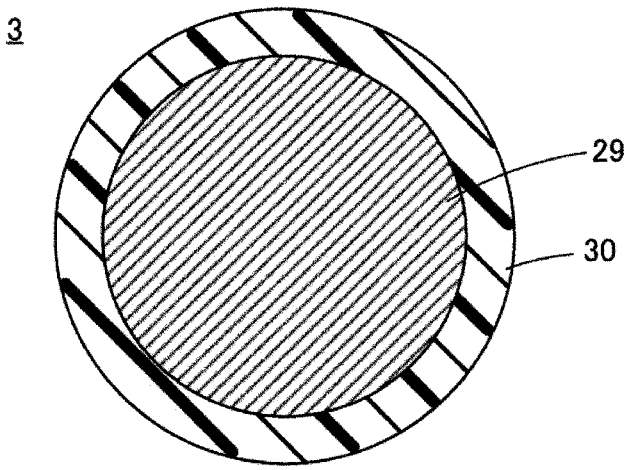
FIG. 3 is an enlarged sectional view of the first wire of the coil component illustrated in FIG. 1 and FIG. 2.

As the first wire 3 is illustrated in FIG. 3, each of the wires 3 and 4 prepared when the coil component 1 is manufactured has a substantially circular section and includes a linear, central conductor 29 and an insulating film 30 that is composed of an electrical-insulation resin and that covers the circumferential surface of the central conductor 29. The diameter of the section of the wire 3 is, for example, about 40 μm. The diameter of the section of the central conductor 29 is no less than 15 μm and no more than 100 μm (i.e., from 15 μm to 100 μm), preferably about 30 μm. The thickness of the section of the insulating film 30 is no less than 8 μm and no more than 20 μm (i.e., from 8 μm to 20 μm), preferably about 10 μm.

The central conductor 29 is composed of, for example, a highly conductive metal such as copper, silver, or gold. The insulating film 30 is composed of a resin such as polyurethane or polyamide imide.

The first wire 3 and the second wire 4 are helically wound around the winding core portion 5 in the same direction. More specifically, as illustrated in FIG. 2, two layers are formed such that the first wire 3 is wound inside the second wire 4, and the second wire 4 is wound outside the first wire 3. In FIG. 2, the numeral illustrated in the section of each of the first wire 3 and the second wire 4 represents a turn ordinal number that means the number of the turns that is counted from the turn nearest to the first flange portion 6 (see FIG. 1). In FIG. 2, the first turn to the fourth turn of the first wire 3 and the first turn to the fourth turn of the second wire 4 are illustrated, and an illustration of the fifth turn and later of the wires 3 and 4 is omitted. The total number of the turns of each of the first wire 3 and the second wire 4 is, for example, 28 turns.

Figure 2:
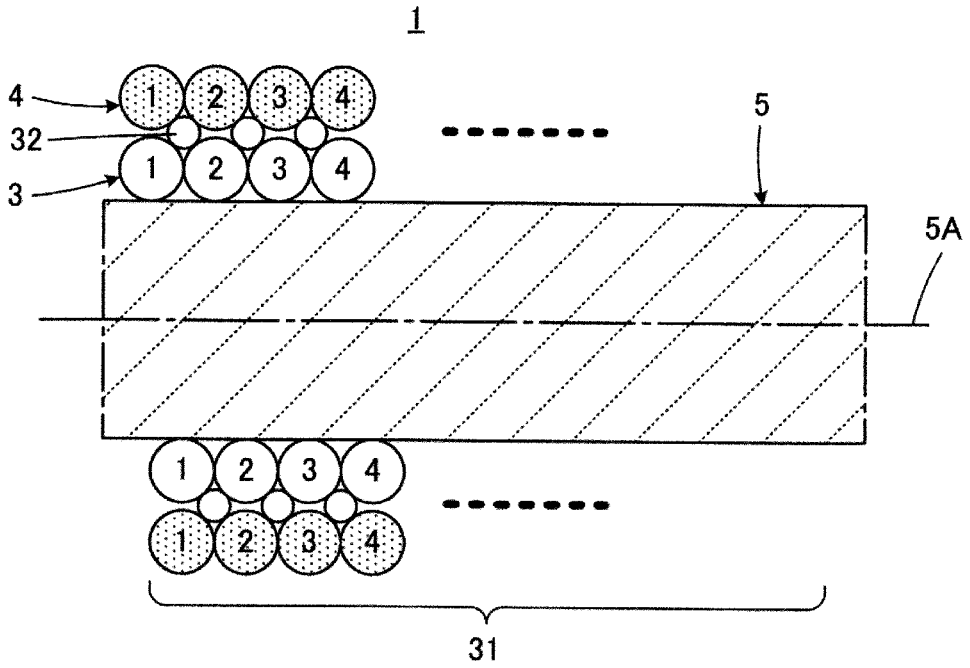
FIG. 2 is a schematic sectional view of a first wire, a second wire, and an auxiliary line of the coil component illustrated in FIG. 1 and illustrates a state where the first wire, the second wire, and the auxiliary line are wound.

In FIG. 2, the second wire 4 is illustrated by hatching to distinguish the first wire 3 and the second wire 4 more clearly in the figure. Also, in other figures, the second wire 4 is illustrated by hatching.

Features of the winding form of the first wire 3 and the second wire 4 will now be described with reference to FIG. 2. The n-th turn (n is a natural number) of the second wire 4 is outside the n-th turn of the first wire 3 when the ordinal number is counted from the turn nearest to the first flange portion 6. The n-th turn of the second wire 4 and the n-th turn of the first wire 3 are aligned in a direction perpendicular to the central axis 5A of the winding core portion 5.

A region in which the first wire 3 and the second wire 4 are wound such that the turns of the first wire 3 and the turns of the second wire 4 having the same ordinal number are aligned with each other in the direction perpendicular to the central axis 5A as above is referred to as an alignment winding region. In particular, a first alignment winding region 31 is a region in which the second wire 4 is continuously wound so as to have turns such that the turns of the second wire 4 are aligned with the turns of the first wire 3 having the same ordinal number outside the first wire 3 in the direction perpendicular to the central axis 5A when the ordinal number is counted from the turn nearest to the first flange portion 6. In the first alignment winding region 31, the first wire 3 and the second wire 4 are helically wound so as to have the continuous turns.

In the case of the above winding form of the first wire 3 and the second wire 4, the turns of the first wire 3 and the turns of the second wire 4 having the same ordinal number are aligned with each other and closest to each other, and the distance between the different turns can be ensured. Accordingly, the stray capacitance that occurs between the different turns of the first wire 3 and the second wire 4 can be decreased. The decrease in the stray capacitance that occurs between the different turns of the first wire 3 and the second wire 4 decreases the asymmetry in the direction in which the stray capacitance occurs between the first wire 3 and the second wire 4. Accordingly, mode conversion between a common mode noise and a differential mode signal can be reduced in the common mode choke coil 1.

Figure 4:
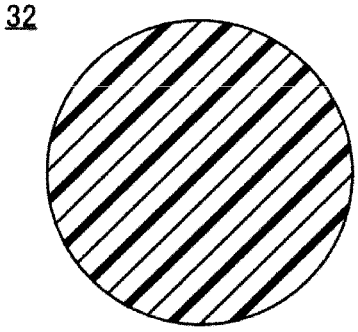
FIG. 4 is an enlarged sectional view of the auxiliary line of the coil component illustrated in FIG. 1 and FIG. 2.

According to the embodiment, an auxiliary line 32 is used to make it easy to wind the second wire 4 with the second wire 4 aligned with the first wire 3 as above and to make a winding state stable. The auxiliary line 32 contains an electrical-insulation resin. The electrical-insulation resin is preferably a resin having a relatively low dielectric constant such as a polyethylene resin, a fluorine resin, or a polyimide resin. According to the embodiment, as illustrated in FIG. 4, the auxiliary line 32 has a substantially circular section and is composed of an electrical-insulation resin. The diameter of the section of the auxiliary line 32 is, for example, about 15 μm.

In the first alignment winding region 31, the auxiliary line 32 is helically wound in the same direction as the first wire 3 with the auxiliary line 32 fitted in a recessed portion formed between the continuous turns of the first wire 3. Accordingly, in the case where the second wire 4 is helically wound in the same direction as the auxiliary line 32 with the second wire 4 fitted in a recessed portion formed between the continuous turns of the auxiliary line 32, the second wire 4 is wound with the position of the second wire 4 set by the auxiliary line 32. Consequently, the second wire 4 is not fitted in a recessed portion formed between the adjacent turns of the first wire 3, and the turns of the first wire 3 and the turns of the second wire 4 having the same ordinal number can be readily aligned with each other. The existence of the auxiliary line 32 is conductive to a stable winding state of the first wire 3 and the second wire 4.

When the auxiliary line 32 is composed of a resin having a relatively low dielectric constant as above, the stray capacitance that can occur between the first wire 3 and the second wire 4 can be further decreased. Consequently, for example, high-frequency characteristics of Scc21 in the common mode choke coil can be improved.

If the above advantages are not particularly expected, the auxiliary line 32 may be composed of, for example, a resin that contains powder of silicon, ferrite, or alumina. Such a composite material has a relatively high dielectric constant unlike the above resin, the stray capacitance that can occur between the first wire 3 and the second wire 4 increases. In some case, however, this brings an advantage of an increase in the adjustment range of a characteristic impedance.

Figure 5:
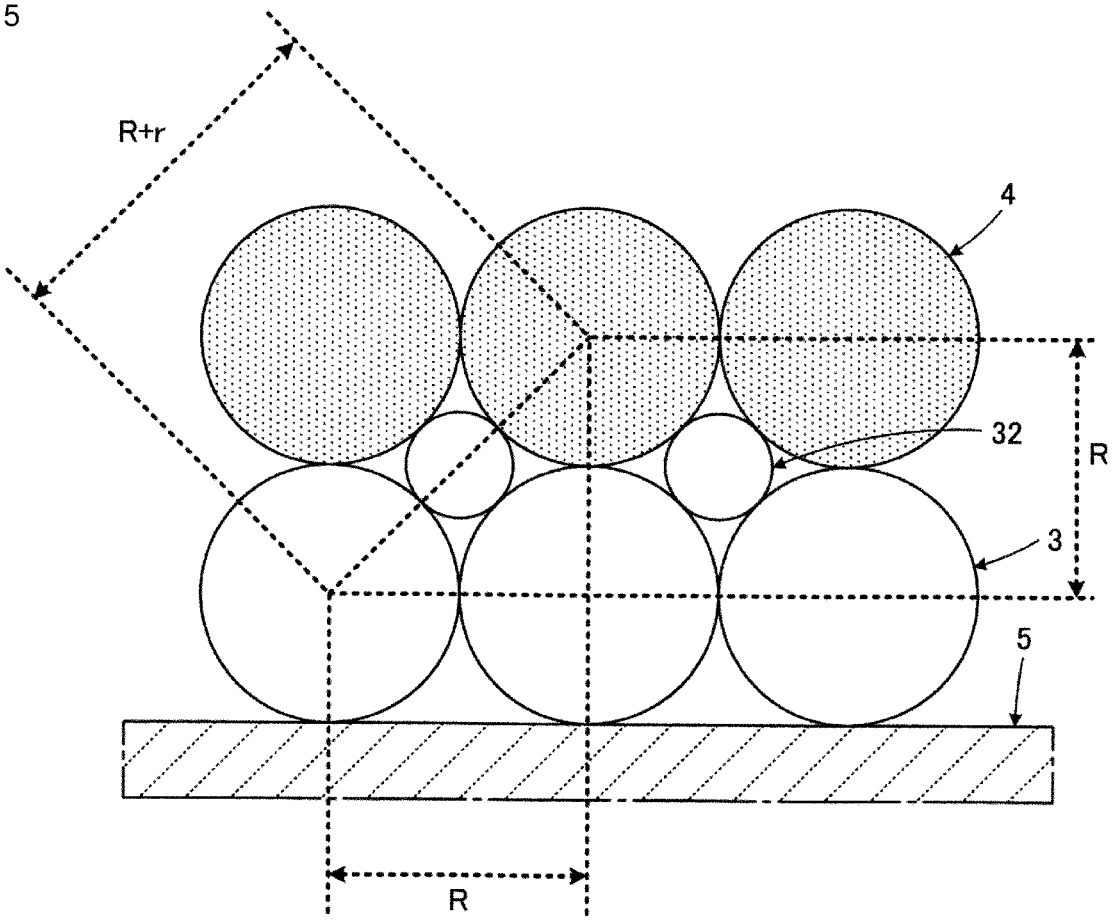
FIG. 5 schematically illustrates an ideal relationship between the diameter R of the first and second wires and the diameter r of the auxiliary line in a sectional view.

FIG. 5 schematically illustrates an ideal relationship between the diameter R of the section of the first and second wires 3 and 4 and the diameter r of the section of the auxiliary line 32. In the following description, the diameter R is also referred to as the diameter of the first wire 3 or the diameter of the second wire 4, and the diameter r is also referred to as the diameter of the auxiliary line 32. In FIG. 5 and in FIG. 6 and FIG. 7 that are described later, the first wire 3 is wound such that there is no space between the turns. In reality, however, there may be a small space therebetween.

As illustrated in FIG. 5, the most preferable state of the wires is as follows. The auxiliary line 32 is in contact with the two adjacent turns of the first wire 3 and the two adjacent turns of the second wire 4 located therearound. The adjacent turns of the first wire 3 are in contact with each other. The adjacent turns of the second wire 4 are in contact with each other. The turns of the second wire 4 that are aligned with the corresponding turns of the first wire 3 in the direction perpendicular to the central axis 5A of the winding core portion 5 are in contact with the top thereof. In this case, according to Pythagorean theorem, an expression of $(R+r)^2=2R^2$ is satisfied. From the expression, r is given as $r=(\sqrt{2}-1)R\cong 0.4$ R. That is, the diameter r of the auxiliary line 32 is most preferably about 0.4 times the diameter R of the first wire 3 and the second wire 4.

Figure 6:
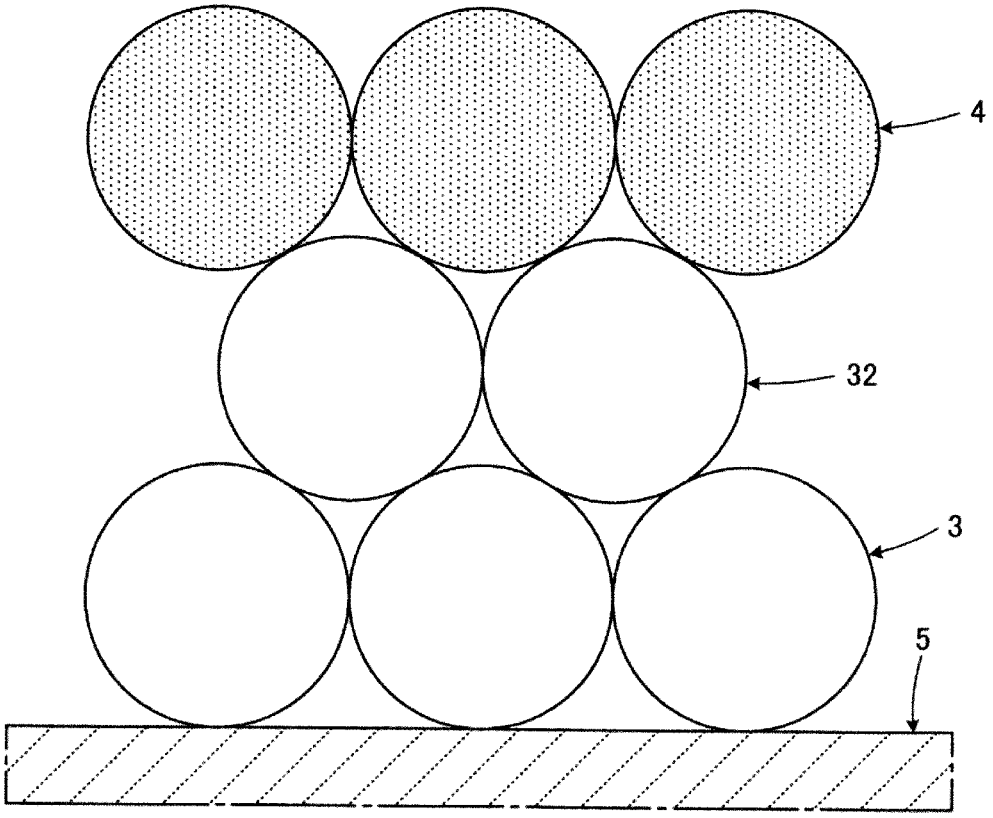
FIG. 6 corresponds to FIG. 5 and illustrates a method of obtaining the upper limit of the diameter r of the auxiliary line that is preferable for the relationship between the diameter R of the first and second wires and the diameter r of the auxiliary line in a schematic sectional view.

Referring to FIG. 6, the upper limit of the diameter r of the auxiliary line 32 that is preferable for the relationship between the diameter R of the first and second wires 3 and 4 and the diameter r of the auxiliary line 32 can be obtained. In a state illustrated in FIG. 6, the diameter r of the auxiliary line 32 is equal to the diameter R of the first wire 3 and the second wire 4. In this case, the auxiliary line 32 is in contact with the two adjacent turns of the first wire 3 and the two adjacent turns of the second wire 4 located therearound, the adjacent turns of the first wire 3 are in contact with each other, and the adjacent turns of the second wire 4 are in contact with each other. However, the turns of the second wire 4 that are aligned with the corresponding turns of the first wire 3 in the direction perpendicular to the central axis 5A of the winding core portion 5 are not in contact with the turns of the first wire 3.

If the diameter r of the auxiliary line 32 is increased from that in the above state, a specific turn of the auxiliary line 32 can be fitted in the recessed portion formed between specific adjacent turns of the first wire 3. However, the turn adjacent to the above specific turn of the auxiliary line 32 is pushed out by the specific turn and is no longer fitted in the recessed portion formed between the adjacent turns of the first wire 3, and the auxiliary line 32 is not stably wound. Accordingly, the turns of the second wire 4 are unlikely to be aligned with the turns of the first wire 3 having the same ordinal number. Accordingly, the preferable upper limit of the diameter r of the auxiliary line 32 is equal to the diameter R of the first wire 3 and the second wire 4.

Figure 7:
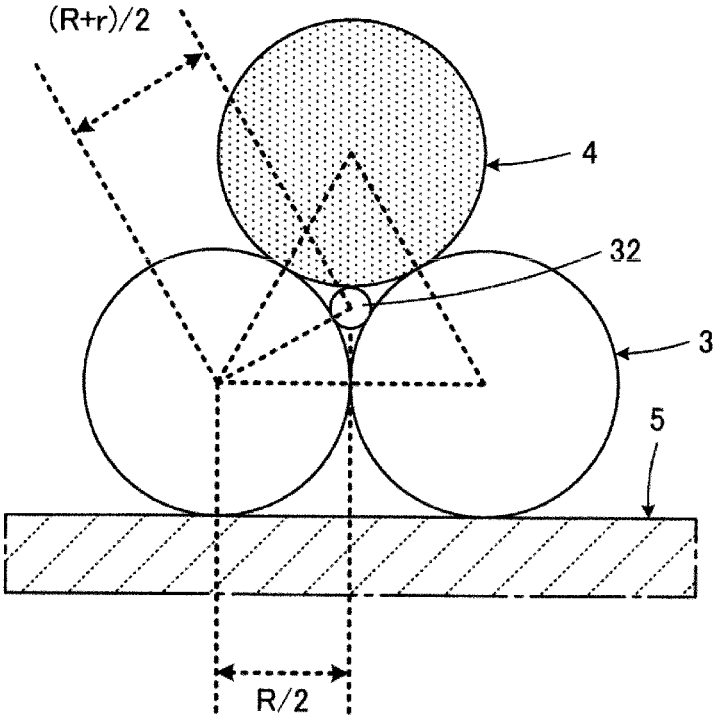
FIG. 7 corresponds to FIG. 5 and illustrates a method of obtaining the lower limit of the diameter r of the auxiliary line that is preferable for the relationship between the diameter R of the first and second wires and the diameter r of the auxiliary line in a schematic sectional view.

Referring to FIG. 7, the lower limit of the diameter r of the auxiliary line 32 that is preferable for the relationship between the diameter R of the first and second wires 3 and 4 and the diameter r of the auxiliary line 32 can be obtained. In a state illustrated in FIG. 7, the auxiliary line 32 is in contact with the two adjacent turns of the first wire 3 and a specific turn of the second wire 4 located therearound, and the specific turn of the second wire 4 is fitted in the recessed portion formed between the adjacent turns of the first wire 3. In this state, a relationship of $(R/2)/\{(R+r)/2\}=\cos 30^{\circ}=/2$ is satisfied. From the expression, r is given as $r=(2\sqrt{3}/3-1)$ R.

If the diameter r of the auxiliary line 32 is decreased from that in the above state, an effect of the auxiliary line 32 to align the second wire 4 is greatly decreased, and the second wire 4 is likely to be fitted in the recessed portion formed between specific adjacent turns of the first wire 3. In the above expression of $r=(2\sqrt{3}/3-1)$ R, a relationship of $(2\sqrt{3}/3-1)=0.154701$ is satisfied. In the case where 0.154701 is approximated to 0.16 with an extra left, calculation of the preferable lower limit of the diameter r of the auxiliary line 32 results in r=0.16 R.

Thus, a preferable range of the diameter r of the auxiliary line 32 can be expressed as $0.16\ R\leq r\leq R$.

It is defined that, in the first alignment winding region 31, the n-th turn of the second wire 4 and the n-th turn of the first wire 3 are aligned with each other in the direction perpendicular to the central axis 5A of the winding core portion 5. However, an aligned state has a predetermined permissible range.

The permissible range of the aligned state of the first wire 3 and the second wire 4 will be described with reference to FIGS. 8A to 8G. FIGS. 8A to 8G illustrate the (i−1)-th turn, the i-th turn, and the (i+1)-th turn of the first wire 3 and the i-th turn of the second wire 4 that ought to be aligned with the i-th turn of the first wire 3. In FIGS. 8A to 8G, two dashed lines 33 and 34, which extend vertically in the direction perpendicular to the central axis 5A of the winding core portion 5, are reference lines that are defined by the positions of two outermost points of the i-th turn of the first wire 3. More specifically, the dashed line 33 is the reference line that passes at the middle position between the (i−1)-th turn and the i-th turn of the first wire and is perpendicular to the central axis 5A of the winding core portion 5. The dashed line 34 is the reference line that passes at the middle position between the i-th turn and the (i+1)-th turn of the first wire and is perpendicular to the central axis 5A of the winding core portion 5.

Figures 8A, 8B, 8C, 8D, 8E, 8F, 8G:
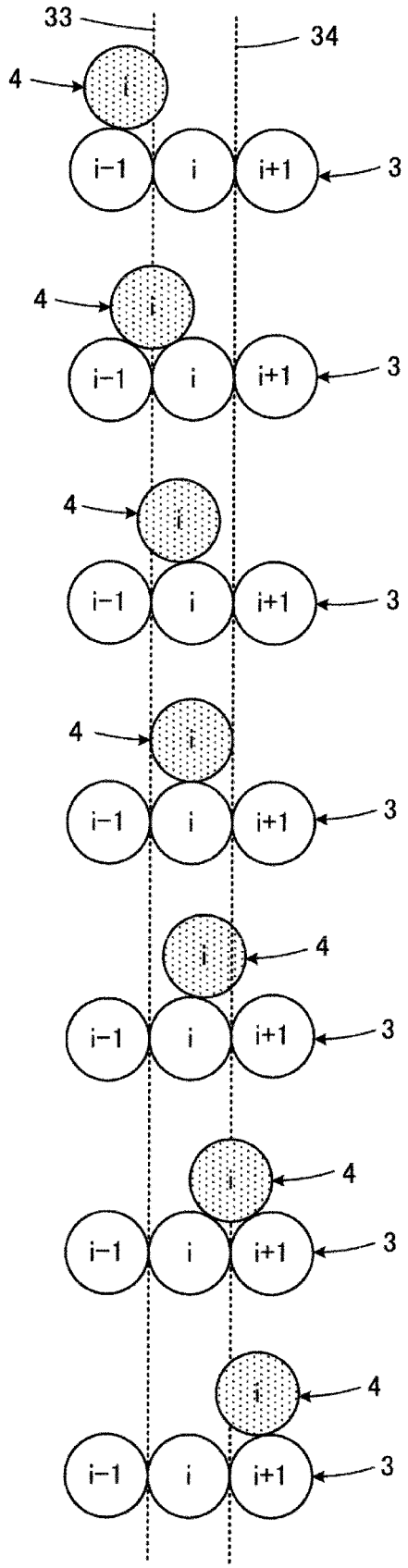
FIGS. 8A to 8G illustrate a permissible range of an aligned state of the first wire and the second wire.

FIGS. 8C, 8D, and 8E illustrate the aligned state. In FIG. 8D, the i-th turn of the second wire 4 is aligned with the i-th turn of the first wire 3 on the top thereof. In FIG. 8C and FIG. 8E, although the i-th turn of the second wire 4 is not on the top of the i-th turn of the first wire 3, more than half of the i-th turn of the second wire 4 is in a region that is interposed between the dashed lines 33 and 34. These states are referred to as the aligned state.

In FIG. 8A and FIG. 8G, a most part of the i-th turn of the second wire 4 is not in the region that is interposed between the dashed lines 33 and 34. These states are not referred to as the aligned state.

In FIG. 8B and FIG. 8F, half of the i-th turn of the second wire 4 is in the region that is interposed between the dashed lines 33 and 34. However, the other half of the i-th turn of the second wire 4 is not in the region that is interposed between the dashed lines 33 and 34. These states are not referred to as the aligned state. In other words, the aligned state means that the center of the i-th turn of the second wire 4 is in the region that is interposed between the dashed line 33 and the dashed line 34.

A process of winding the first wire 3, a process of winding the second wire 4, and a process of winding the auxiliary line 32 will now be described with reference to FIGS. 9A to 9C.

Figure 9A:
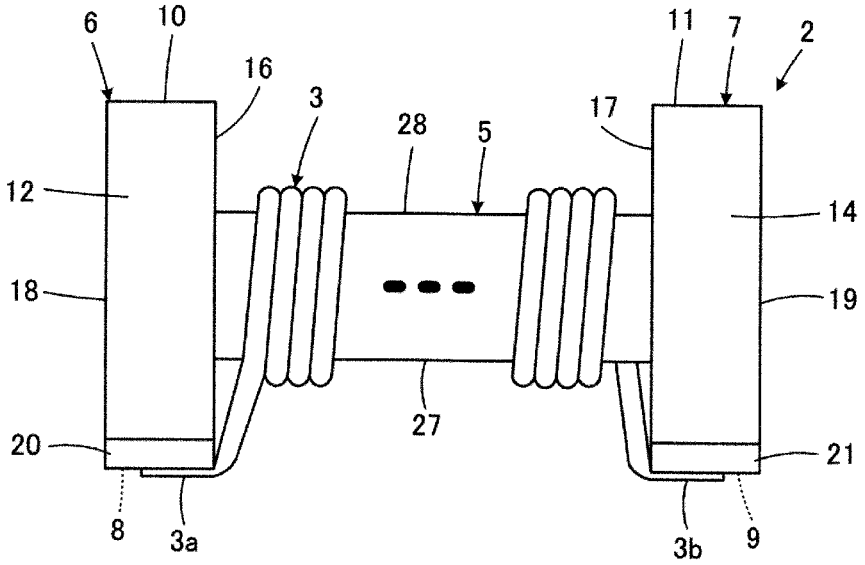
FIGS. 9A to 9C illustrate processes of winding the first wire, the second wire, and the auxiliary line illustrated in FIG. 1 and FIG. 2 and illustrate the coil component from the front.

FIG. 9A illustrates the process of winding the first wire 3. As illustrated also in FIG. 1, a first end 3*a* of the first wire 3 is first electrically connected to the first terminal electrode 20 on the first flange portion 6. The first end 3*a* is connected by, for example, thermo-compression bonding. The insulating film 30 (see FIG. 3) is removed from the first end 3*a* of the first wire 3. The first wire 3 is connected to the first terminal electrode 20 with the central conductor 29 exposed.

Subsequently, the first wire 3 is helically wound around the winding core portion 5. A second end 3*b* of the first wire 3 opposite the first end 3*a* is electrically connected to the second terminal electrode 21 on the second flange portion 7. The second end 3*b* is also connected by, for example, thermo-compression bonding. The insulating film 30 is removed from the second end 3*b* of the first wire 3. The first wire 3 is connected to the second terminal electrode 21 with the central conductor 29 exposed.

Figure 9B:
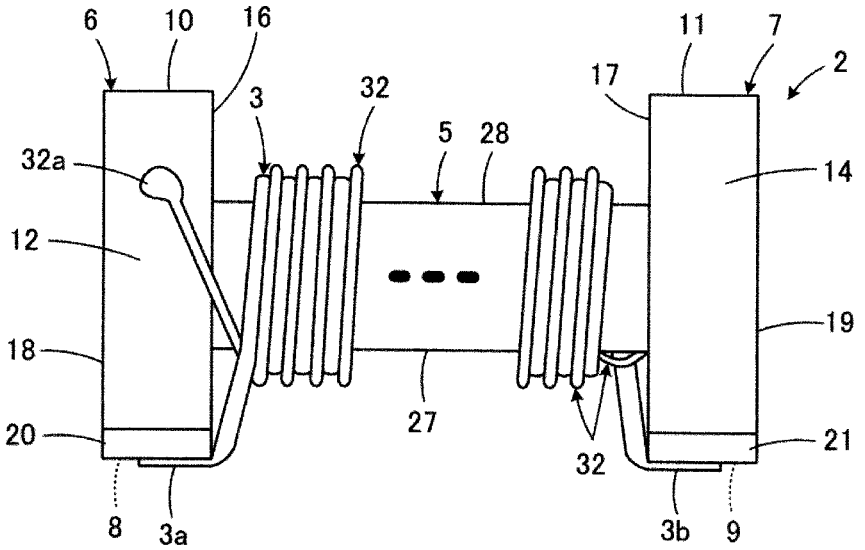

Subsequently, as illustrated in FIG. 9B, the auxiliary line 32 is wound. A first end 32*a* of the auxiliary line 32 is first fusion-bonded to the side surface 12 of the first flange portion 6 by thermo-compression bonding. Securing the auxiliary line 32 by fusion-bonding enables a strong securing force to be expected. The thermo-compression bonding is performed at a temperature at which the resin of which the auxiliary line 32 is composed is not volatilized. The auxiliary line 32 may include a fusion-bonding layer that is formed on a surface thereof and that is composed of a material having a melting point lower than that of the resin of the main body thereof or a curing temperature lower than that of the resin. The fusion-bonding layer enables a strong securing force to be expected and enables a risk of disconnection of the auxiliary line 32 to be decreased.

Subsequently, the auxiliary line 32 is helically wound in the same direction as the first wire 3 with the auxiliary line 32 fitted in the recessed portion formed between the continuous turns of the first wire 3. A second end 32*b* of the auxiliary line 32 opposite the first end 32*a* is fusion-bonded to the side surface 15 of the second flange portion 7 by thermo-compression bonding in the same manner as with the first end 32*a*. FIG. 1 illustrates the secured second end 32*b* of the auxiliary line 32.

The first end 32*a* and the second end 32*b* of the auxiliary line 32 are preferably nearer than the center of the side surfaces 12 and 15 in a height direction to the upper surfaces 10 and 11, where the height direction is a direction in which the bottom surfaces 8 and 9 of the flange portions 6 and 7 are connected to the upper surfaces 10 and 11. This increases the distance between each portion at which the auxiliary line 32 is secured and the mounting substrate and decreases the risk of disconnection of the auxiliary line 32, which is caused by, for example, a coating material that may be applied to the coil component 1 together with the mounting substrate after mounting. In addition, a residue that can be produced when the auxiliary line 32 is secured can be inhibited from being produced on the bottom surfaces 8 and 9 and can be inhibited from reaching the bottom surfaces 8 and 9, and the mounting surface can be inhibited from being affected by the residue. The above height direction coincides with the thickness direction T in FIG. 1.

Figure 9C:
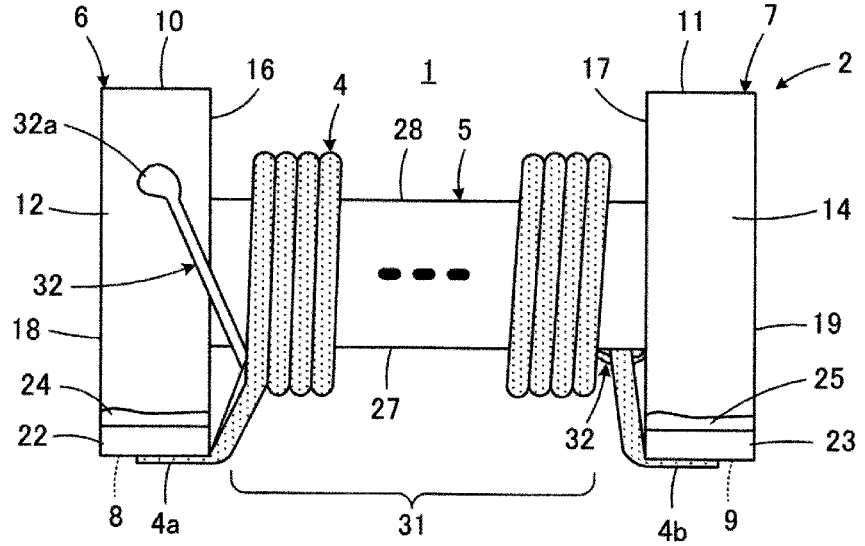

Subsequently, as illustrated in FIG. 9C, the second wire 4 is wound. A first end 4*a* of the second wire 4 is first electrically connected to the third terminal electrode 22 on the first flange portion 6. The first end 4*a* is also connected by, for example, thermo-compression bonding. The insulating film 30 (see FIG. 3) is removed from the first end 4*a* of the second wire 4. The second wire 4 is connected to the third terminal electrode 22 with the central conductor 29 exposed.

Subsequently, the second wire 4 is helically wound in the same direction as the auxiliary line 32 with the second wire 4 fitted in the recessed portion formed between the adjacent turns of the auxiliary line 32 while the position of the second wire 4 is controlled by the auxiliary line 32. A second end 4*b* of the second wire 4 opposite the first end 4*a* is electrically connected to the fourth terminal electrode 23 on the second flange portion 7. The second end 4*b* is also connected by, for example, thermo-compression bonding. The insulating film 30 is removed from the second end 4*b* of the second wire 4. The second wire 4 is connected to the fourth terminal electrode 23 with the central conductor 29 exposed.

The process of winding the first wire 3, the process of winding the second wire 4, and the process of winding the auxiliary line 32 are thus finished, and the coil component 1 is completed.

Figure 10:
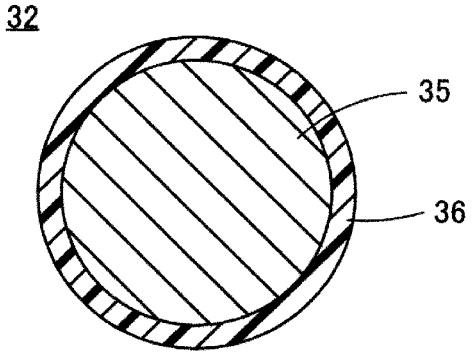
FIG. 10 is an enlarged sectional view of a modification to the auxiliary line and corresponds to FIG. 4.
Figure 11:
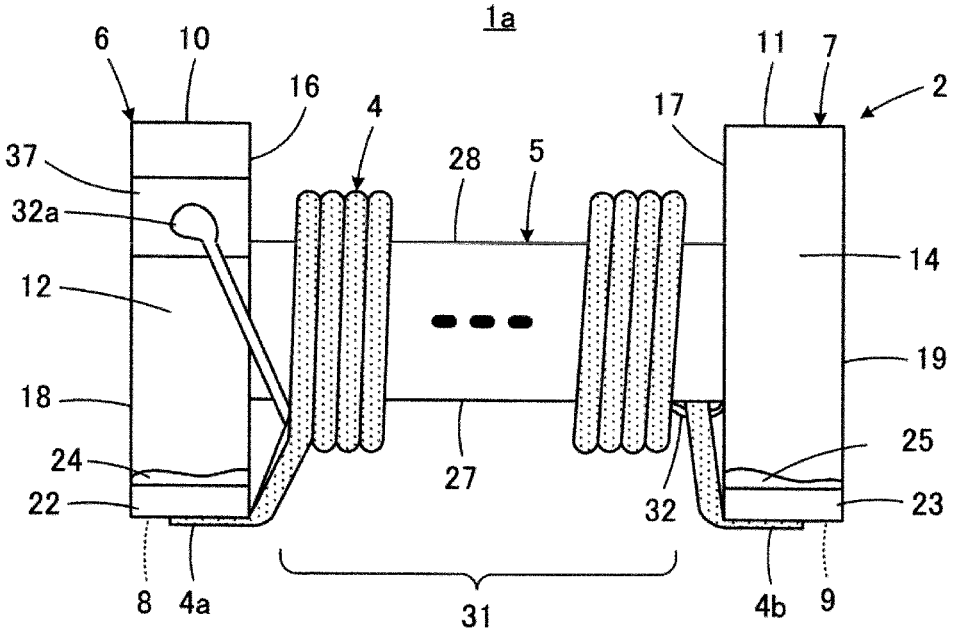
FIG. 11 is a front view of a coil component that is manufactured by using the auxiliary line illustrated in FIG. 10.

The auxiliary line 32 may has a structure illustrated in FIG. 10. The auxiliary line 32 illustrated in FIG. 10 includes a linear, central conductor 35 and an insulating film 36 that is composed of an electrical-insulation resin and that covers the circumferential surface of the central conductor 35. In the case where the auxiliary line 32 illustrated in FIG. 10 is used, an auxiliary electrode 37 is preferably disposed on a surface of the drum-shaped core 2 as in a coil component 1*a* illustrated in FIG. 11. In FIG. 11, the auxiliary electrode 37 is disposed on the side surface 12 of the first flange portion 6. The first end 32*a* of the auxiliary line 32 is connected to the auxiliary electrode 37 by, for example, thermo-compression bonding. At this time, the insulating film 36 is removed from the first end 32*a* of the auxiliary line 32. The central conductor 35 is joined to the auxiliary electrode 37.

An auxiliary electrode is also disposed on, for example, the side surface 15 of the second flange portion 7 although this is not illustrated in FIG. 11. The second end 32*b* of the auxiliary line 32 is connected to the auxiliary electrode.

The use of the auxiliary line 32 having the central conductor 35 in the above manner makes it easy to secure the auxiliary line 32 to the drum-shaped core 2 highly reliably. In addition, the stray capacitance between the wires 3 and 4 increases. In some case, however, this brings an advantage of an increase in the adjustment range of the characteristic impedance.

As seen from FIG. 11, the auxiliary electrode 37 is preferably nearer than the center of the side surfaces 12 and 15 in the height direction to the upper surfaces 10 and 11 so that the first end 32*a* and the second end 32*b* of the auxiliary line 32 are nearer than the center of the side surfaces 12 and 15 in the height direction to the upper surfaces 10 and 11.

The auxiliary electrode 37 can be disposed on any surface of the flange portions 6 and 7, preferably other than the bottom surfaces 8 and 9. In the case where the auxiliary electrode 37 is disposed on a surface other than the bottom surfaces 8 and 9 of the flange portions 6 and 7, the distance between each position at which the auxiliary line 32 is secured, that is, the first end 32*a* and the second end 32*b*, and the mounting substrate can be increased. This decreases the risk of disconnection of the auxiliary line 32, which is caused by, for example, the coating material that may be applied to the coil component 1 together with the mounting substrate after mounting. In addition, the residue that can be produced when the auxiliary line 32 is secured can be inhibited from being produced on the bottom surfaces 8 and 9 and can be inhibited from reaching the bottom surfaces 8 and 9, and the mounting surface can be inhibited from being affected by the residue. Furthermore, a land pattern on the mounting substrate can inhibited from being affected by the auxiliary electrode 37.

Figure 12:
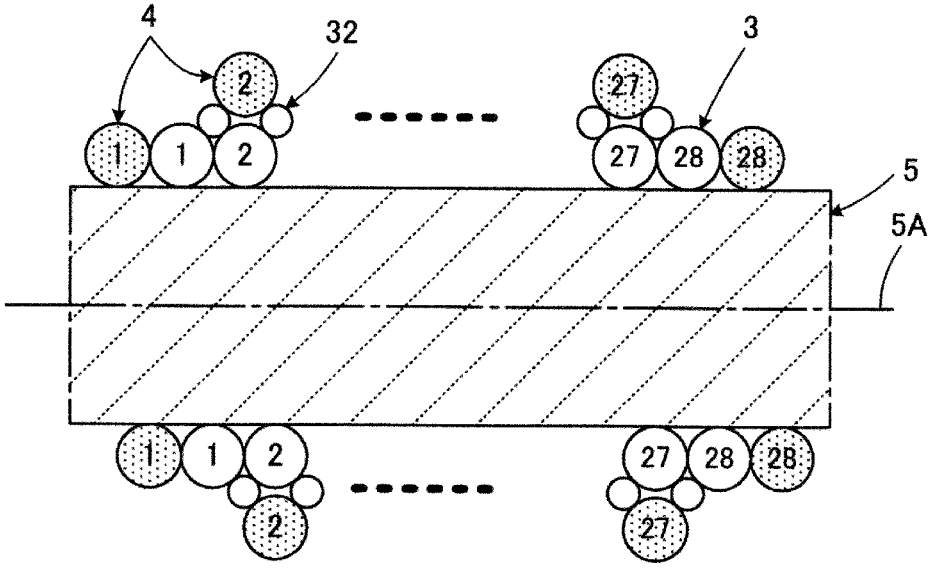
FIG. 12 is a schematic sectional view of a modification to the state where the first wire and the second wire are wound and corresponds to FIG. 2.

FIG. 12 is a schematic sectional view of a modification to the state where the first wire 3 and the second wire 4 are wound and corresponds to FIG. 2. In FIG. 12, the start and end of the winding of the second wire 4, which ought to be wound around outside the first wire 3, are wound directly around the winding core portion 5. In an example illustrated in FIG. 12, the total number of the turns of each of the first wire 3 and the second wire 4 is 28, and the first turn and the twenty-eighth turn of the second wire 4 are wound directly around the winding core portion 5.

The phenomenon illustrated in FIG. 12 can occur unexpectedly. The turns of the second wire 4 that are wound directly around the winding core portion 5 are not limited to the first turn and the twenty-eighth turn. The turns adjacent to the first turn or the twenty-eighth turn may be wound directly around the winding core portion 5. An intermediate turn may be wound directly around the winding core portion 5 with the intermediate turn and the first and twenty-eighth turns interposing the first alignment winding regions 31 therebetween.

Figure 13:
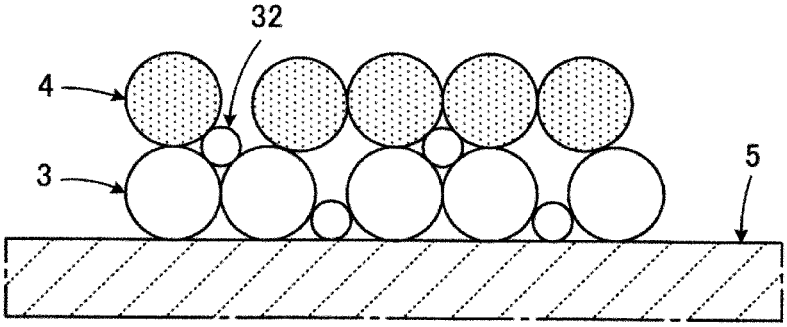
FIG. 13 is a schematic sectional view of a modification to the state where the auxiliary line is wound and corresponds to FIG. 2.

FIG. 13 is a schematic sectional view of a modification to the state where the auxiliary line 32 is wound and corresponds to FIG. 2. In FIG. 13, some of the turns of the auxiliary line 32 are wound directly around the winding core portion 5. Accordingly, the auxiliary line 32 is not fitted in the entire recessed portion formed between the adjacent turns of the first wire 3. Also, in this case, although the effect is somewhat decreased as compared with the structure illustrated in FIG. 2, the first wire 3 and the second wire 4 are readily wound in the aligned state, and the winding state can be stable, that is, the auxiliary line 32 can serve the function. In the perspective of the auxiliary line 32, an advantage of a stable winding shape of the auxiliary line 32 can be expected.

In FIG. 13, the turns of the auxiliary line 32 that are wound directly around the winding core portion 5 are located at intermediate positions of the winding. However, at least one of the ends of the winding of the auxiliary line 32 may be in direct contact with the winding core portion 5.

The phenomenon illustrated in FIG. 13 can occur unexpectedly.

Figure 14:
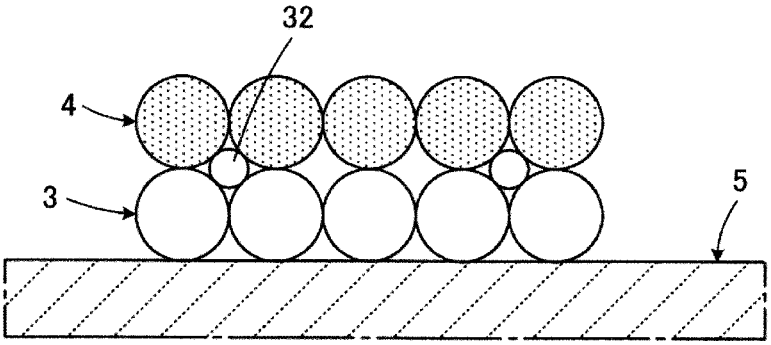
FIG. 14 is a schematic sectional view of another modification to the state where the auxiliary line is wound and corresponds to FIG. 2.

FIG. 14 is a sectional view of another modification to the state where the auxiliary line 32 is wound and corresponds to FIG. 2. In FIG. 14, the auxiliary line 32 is not fitted in the entire recessed portion formed between the adjacent turns of the first wire 3. Also, in this case, although the effect is somewhat decreased as compared with the structure illustrated in FIG. 2, the first wire 3 and the second wire 4 are readily wound in the aligned state, and the winding state can be stable, that is, the auxiliary line 32 can serve the function.

A method for achieving the structure in FIG. 14 is to increase a winding pitch of the auxiliary line 32 to a pitch larger than that of the first wire 3 and the second wire 4 while winding the auxiliary line 32 in the same direction as the first wire 3 and the second wire 4. Another method is to wind the auxiliary line 32 in a direction opposite the direction in which the first wire 3 and the second wire 4 are wound.

A second embodiment will now be described with reference to FIG. 15 and FIG. 16. The second embodiment differs from the first embodiment in including two alignment winding regions 31 and 43 and two auxiliary lines 32 and 42.

In the following description, the alignment winding region 43 is referred to as the second alignment winding region 43 against the first alignment winding region 31 to distinguish the two alignment winding regions 31 and 43. The auxiliary line 32 is referred to as a "first auxiliary line", and the auxiliary line 42 is referred to as a "second auxiliary line" to distinguish the two auxiliary lines 32 and 42.

Figure 15:
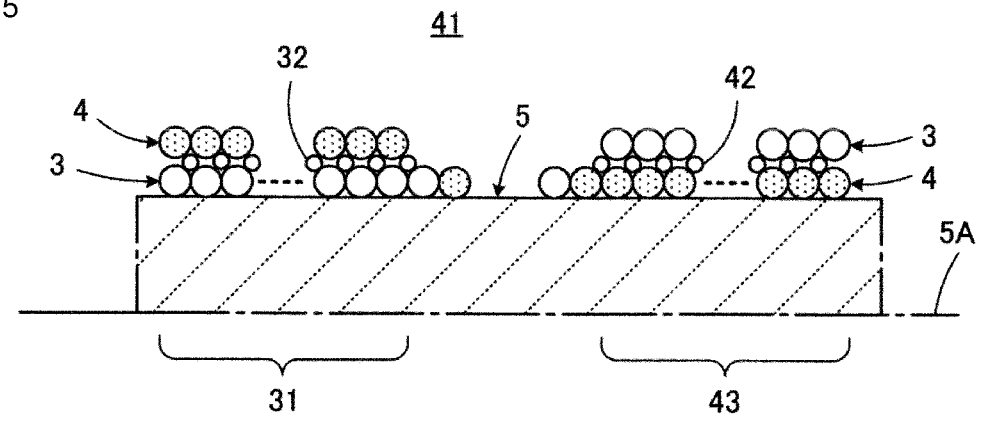
FIG. 15 is a schematic sectional view of the first wire, the second wire, a first auxiliary line, and a second auxiliary line of a coil component according to a second embodiment and illustrates a state where the first wire, the second wire, the first auxiliary line, and the second auxiliary line are wound.

FIG. 15 is a schematic sectional view of the first wire 3, the second wire 4, the first auxiliary line 32, and the second auxiliary line 42 of a coil component 41 according to the second embodiment and illustrates a state where the first wire 3, the second wire 4, the first auxiliary line 32, and the second auxiliary line 42 are wound. FIG. 16 is a bottom view of the coil component 41 illustrated in FIG. 15.

In the coil component 41, the first alignment winding region 31 and the second alignment winding region 43 are arranged along the central axis 5A of the winding core portion 5. The first alignment winding region 31 is near the first flange portion 6 of the winding core portion 5, and the second alignment winding region 43 is nearer than the first alignment winding region 31 to the second flange portion 7 of the winding core portion 5.

The first alignment winding region 31 has the same structure as that according to the first embodiment. That is, in the first alignment winding region 31, the n-th turn of the second wire 4 is outside the n-th turn of the first wire 3, and the n-th turn of the second wire 4 and the n-th turn of the first wire 3 are aligned with each other in the direction perpendicular to the central axis 5A of the winding core portion 5 when the ordinal number is counted from the turn nearest to the first flange portion 6, as described above.

The first auxiliary line 32 is helically wound in the same direction as the first wire 3 with the first auxiliary line 32 fitted in the recessed portion formed between the continuous turns of the first wire 3. The second wire 4 is helically wound in the same direction as the first auxiliary line 32 with the second wire 4 fitted in the recessed portion formed between the continuous turns of the first auxiliary line 32. Consequently, the turns of the first wire 3 and the turns of the second wire 4 having the same ordinal number are aligned with each other.

In the second alignment winding region 43, the vertical relationship between the first wire 3 and the second wire 4 is reversed. That is, the m-th turn (m is a natural number larger than n) of the first wire 3 is outside the m-th turn of the second wire 4, and the m-th turn of the first wire 3 and the m-th turn of the second wire 4 are aligned with each other in the direction perpendicular to the central axis 5A of the winding core portion 5 when the ordinal number is counted from the turn nearest to the first flange portion 6. Also, in the second alignment winding region 43, the first wire 3 and the second wire 4 are helically wound so as to have the continuous turns. That is, in the second alignment winding region 43 nearer than the first alignment winding region 31 to the second flange portion 7, the first wire 3 is continuously wound so as to have turns such that the turns of the first wire 3 are aligned with the turns of the second wire 4 having the same ordinal number outside the second wire 4 in the direction perpendicular to the central axis 5A when the ordinal number is counted from the turn nearest to the first flange portion 6.

The number of the turns of the wires 3 and 4 in the first alignment winding region 31 is preferably equal to the number of the turns of the wires 3 and 4 in the second alignment winding region 43. For example, when the total number of the turns of the first wire 3 and the total number of the turns of the second wire 4 are 28, if the number of the turns of each of the wires 3 and 4 in the first alignment winding region 31 is 13, the number of the turns of each of the wires 3 and 4 in the second alignment winding region 43 is preferably 13, and the number of the turns of each of the wires 3 and 4 in a single layer region between the first alignment winding region 31 and the second alignment winding region 43 is preferably 2.

The second auxiliary line 42 is helically wound in the same direction as the second wire 4 with the second auxiliary line 42 fitted in the recessed portion formed between the continuous turns of the second wire 4. The first wire 3 is helically wound in the same direction as the second auxiliary line 42 with the first wire 3 fitted in the recessed portion formed between the continuous turns of the second auxiliary line 42. Consequently, the turns of the second wire 4 and the turns of the first wire 3 having the same ordinal number are aligned with each other.

Figure 16:
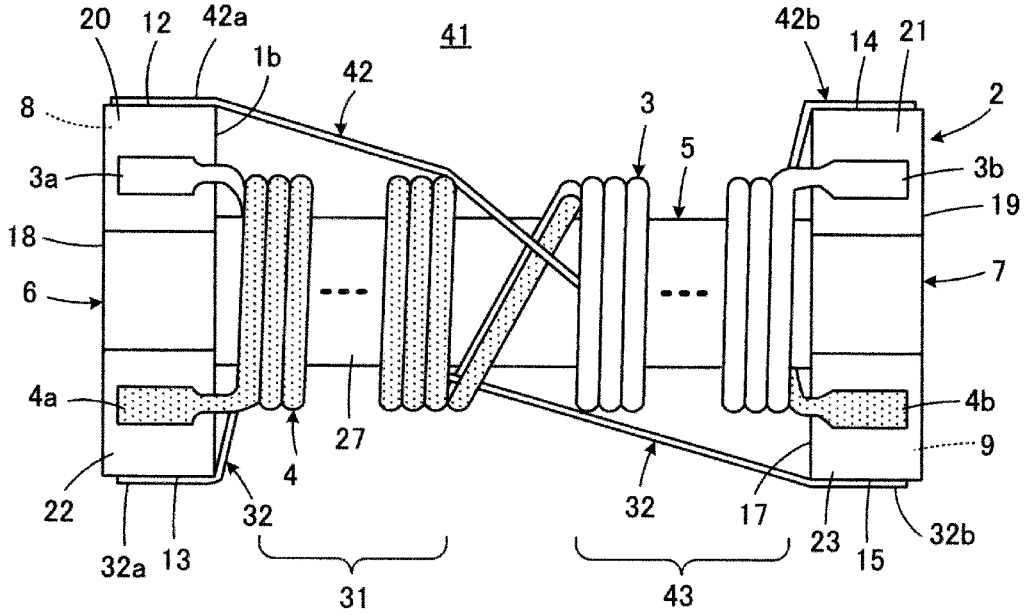
FIG. 16 is a bottom view of the coil component illustrated in FIG. 15.

As illustrated in FIG. 16, the first end 32*a* of the first auxiliary line 32 is secured to, for example, the side surface 13 of the first flange portion 6. Subsequently, the first auxiliary line 32 is wound in the first alignment winding region 31 and then extends from a winding end nearer than the other winding end to the second flange portion 7 toward the second flange portion 7. The first auxiliary line 32 passes between the first wire 3 and the second wire 4 that extend from respective winding ends nearer than the other winding ends to the second flange portion 7 in the first alignment winding region 31 and extends across the outer circumference of the second alignment winding region 43. The second end 32*b* of the first auxiliary line 32 is secured to, for example, the side surface 15 of the second flange portion 7. The first auxiliary line 32 that thus extends decreases the degree of interference of the first auxiliary line 32 with the first alignment winding region 31.

Similarly, as illustrated in FIG. 16, a second end 42*b* of the second auxiliary line 42 is secured to, for example, the side surface 14 of the second flange portion 7. Subsequently, the second auxiliary line 42 is wound in the second alignment winding region 43 and then extends from a winding end nearer than the other winding end to the first flange portion 6 toward the first flange portion 6. Subsequently, the second auxiliary line 42 passes outside the first wire 3 and the second wire 4 that extend from respective winding ends nearer than the other winding ends to the first flange portion 6 in the second alignment winding region 43 and extends across the outer circumference of the first alignment winding region 31. A first end 42*a* of the second auxiliary line 42 is secured to, for example, the side surface 12 of the first flange portion 6. The second auxiliary line 42 that thus extends decreases the degree of interference of the second auxiliary line 42 with the second alignment winding region 43 and the single layer region between the first alignment winding region 31 and the second alignment winding region 43.

In the above description, as illustrated in FIG. 16, the first auxiliary line 32 passes between the first wire 3 and the second wire 4 from the winding end nearer than the other winding end to the second flange portion 7. However, the first auxiliary line 32 may pass outside the first wire 3 and the second wire 4. This decreases the degree of interference of the first auxiliary line 32 with the single layer region. Similarly, the second auxiliary line 42 may pass between the first wire 3 and the second wire 4 from the winding end nearer than the other winding end to the first flange portion 6.

The first auxiliary line 32 and the second auxiliary line 42 are secured to the flange portions 6 and 7 by using the method described with reference to FIG. 9 or FIG. 11.

According to the above second embodiment, the first wire 3 is wound outside the second wire 4 in the second alignment winding region 43. This decreases the differences in length and self-inductance between the first wire 3 and the second wire 4, which are made when the second wire 4 is wound outside the first wire 3 in the first alignment winding region 31. In addition, an effect on signals that pass through the first wire 3 and the second wire 4 can be further decreased. The use of the two auxiliary lines of the first auxiliary line 32 and the second auxiliary line 42 enables the first wire 3 and the second wire 4 to avoid complicatedly interfering with the auxiliary line 32 or 42 between the first alignment winding region 31 and the second alignment winding region 43.

If the above advantages are not particularly expected, the first auxiliary line 32 may double as the first auxiliary line 32 and the second auxiliary line 42. In this case, for example, the first auxiliary line 32 extends from the winding end nearer than the other winding end to the second flange portion 7 in the first alignment winding region 31 and is then wound in the second alignment winding region 43.

The extending form of the first auxiliary line 32 and the second auxiliary line 42 according to a modification to the second embodiment will now be described with reference to FIG. 17.

Figure 17:
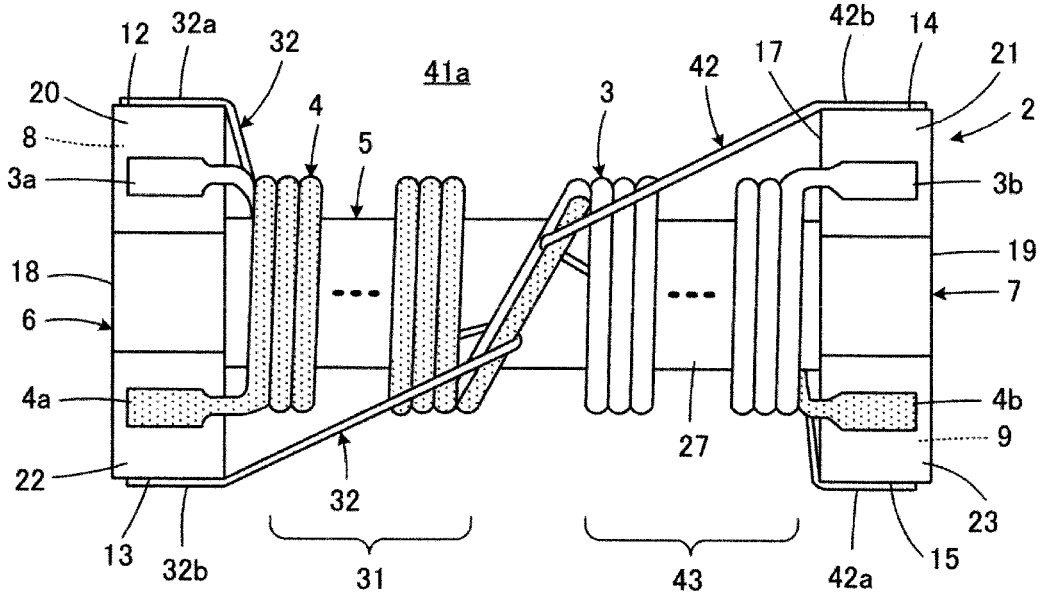
FIG. 17 corresponds to FIG. 16 and is a bottom view of a coil component according to a modification to the extending form of the first auxiliary line and the second auxiliary line.

In a coil component 41*a* illustrated in FIG. 17, the first end 32*a* of the first auxiliary line 32 is secured to, for example, the side surface 12 of the first flange portion 6. Subsequently, the first auxiliary line 32 is wound in the first alignment winding region 31, is then returned toward the first flange portion 6 from the winding end nearer than the other winding end to the second flange portion 7, and extends across the first alignment winding region 31. The second end 32*b* is secured to, for example, the side surface 13 of the first flange portion 6. When the first auxiliary line 32 is returned toward the first flange portion 6 from the winding end nearer than the other winding end to the second flange portion 7, the first auxiliary line 32 is preferably entangled in at least one of the first wire 3 and the second wire 4 to set the position thereof.

The first end 42*a* of the second auxiliary line 42 is secured to, for example, the side surface 15 of the second flange portion 7. Subsequently, the second auxiliary line 42 is wound in the second alignment winding region 43 and is then returned toward the second flange portion 7 from the winding end nearer than the other winding end to the first flange portion 6, and extends across the second alignment winding region 43. The second end 42*b* is secured to, for example, the side surface 14 of the second flange portion 7. When the second auxiliary line 42 is returned toward the second flange portion 7 from the winding end nearer than the other winding end to the first flange portion 6, the second auxiliary line 42 is preferably entangled in at least one of the first wire 3 and the second wire 4 to set the position thereof. The first auxiliary line 32 and the second auxiliary line 42 may be entangled in at least one of the first wire 3 and the second wire 4 by using different methods for the first auxiliary line 32 and the second auxiliary line 42 as illustrated in FIG. 17 or the same method.

According to the modification illustrated in FIG. 17, the first auxiliary line 32 can avoid interfering with the second alignment winding region 43, and the second auxiliary line 42 can avoid interfering with the first alignment winding region 31.

Figure 18:
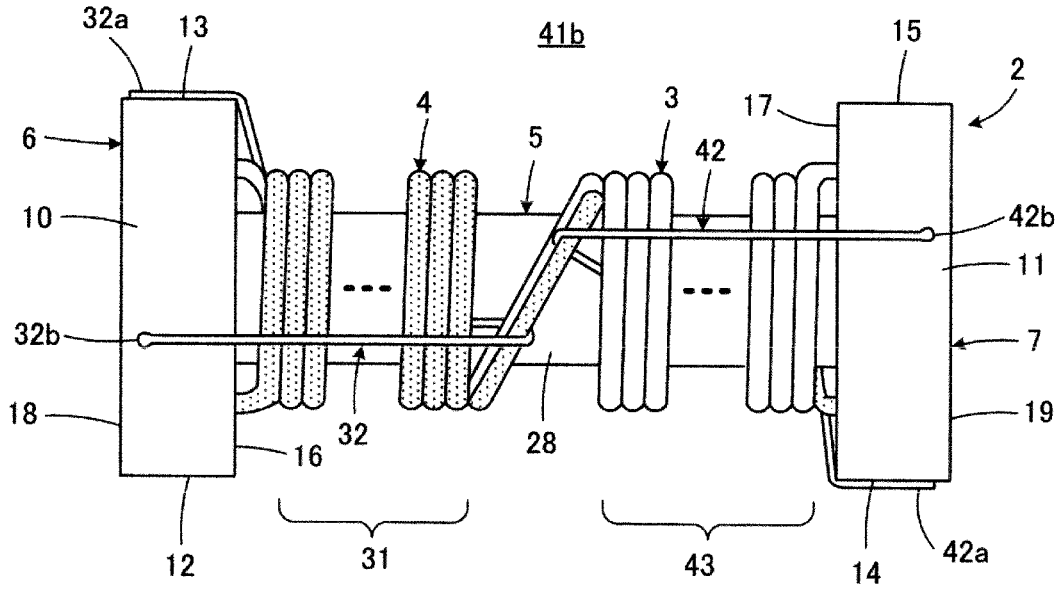
FIG. 18 corresponds to FIG. 16 and is a top view of a coil component according to another modification to the extending form of the first auxiliary line and the second auxiliary line.
Figure 19:
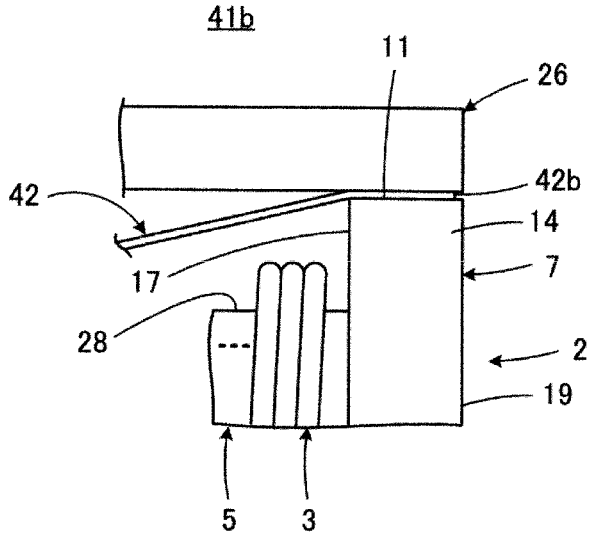
FIG. 19 is a front view of a part of the coil component in which the extending form of the second auxiliary line illustrated in FIG. 18 is used.

The extending form of the first auxiliary line 32 and the second auxiliary line 42 according to another modification to the second embodiment will now be described with reference to FIG. 18 and FIG. 19. FIG. 18 illustrates the upper surface of a coil component 41*b*, that is, the upper surfaces 10 and 11 of the flange portions 6 and 7 and an upper surface 28 of the winding core portion 5. FIG. 19 illustrates a part of the coil component 41*b* from the front, where a part of the side surface 14 of the second flange portion 7 is illustrated.

As illustrated in FIG. 18, the first end 32*a* of the first auxiliary line 32 is secured to, for example, the side surface 13 of the first flange portion 6. Subsequently, the first auxiliary line 32 is wound in the first alignment winding region 31, is then returned toward the first flange portion 6 from the winding end nearer than the other winding end to the second flange portion 7, and extends across the first alignment winding region 31. The second end 32*b* is secured to the upper surface 10 of the first flange portion 6. When the first auxiliary line 32 is returned toward the first flange portion 6 from the winding end nearer than the other winding end to the second flange portion 7, the first auxiliary line 32 is preferably entangled in at least one of the first wire 3 and the second wire 4 to set the position thereof.

The first end 42*a* of the second auxiliary line 42 is secured to, for example, the side surface 14 of the second flange portion 7. Subsequently, the second auxiliary line 42 is wound in the second alignment winding region 43, is then returned toward the second flange portion 7 from the winding end nearer than the other winding end to the first flange portion 6, and extends across the second alignment winding region 43. The second end 42*b* is secured to the upper surface 11 of the second flange portion 7. When the second auxiliary line 42 is returned toward the second flange portion 7 from the winding end nearer than the other winding end to the first flange portion 6, the second auxiliary line 42 is preferably entangled in at least one of the first wire 3 and the second wire 4 to set the position thereof.

According to the present modification, as seen from FIG. 19 illustrating the second end 42*b* of the second auxiliary line 42, the second end 32*b* of the first auxiliary line 32 and the second end 42*b* of the second auxiliary line 42 are interposed between the upper surfaces 10 and 11 of the flange portions 6 and 7 and the plate core 26. In this case, steps may be formed on the upper surfaces 10 and 11 or the plate core 26 in regions in which the first auxiliary line 32 and the second auxiliary line 42 are interposed. This inhibits the first auxiliary line 32 and the second auxiliary line 42 from affecting the gaps between the upper surfaces 10 and 11 and the plate core 26.

According to the present modification, the first auxiliary line 32 can avoid interfering with the second alignment winding region 43, the second auxiliary line 42 can avoid interfering with the first alignment winding region 31 as in the modification illustrated in FIG. 17. In addition, the risk of disconnection of the auxiliary lines 32 and 42, which is caused by, for example, the coating material that may be applied to the coil component 1 together with the mounting substrate after mounting, can be decreased.

According to another modification to the above modification, the first end 32*a* and the second end 32*b* of the first auxiliary line 32 and the first end 42*a* and the second end 42*b* of the second auxiliary line 42 may be allocated to any one of the upper surfaces 10 and 11 of the flange portions 6 and 7 and secured thereto.

In examples described according to the above embodiments and the above modifications, the ends of the auxiliary lines are secured to the side surfaces of the flange portions or the upper surfaces of the flange portions. However, the ends may be secured to the bottom surfaces, the outer end surfaces, or the inner end surfaces of the flange portions.

According to the above embodiments and the above modifications, the auxiliary lines 32 and 42 make it easy to wind the first wire 3 and the second wire 4 in the aligned state and make the winding state stable. However, other methods may be used to make the winding state of the first wire 3 and the second wire 4 stable as described below, instead of the use of the auxiliary lines.

Figure 20:
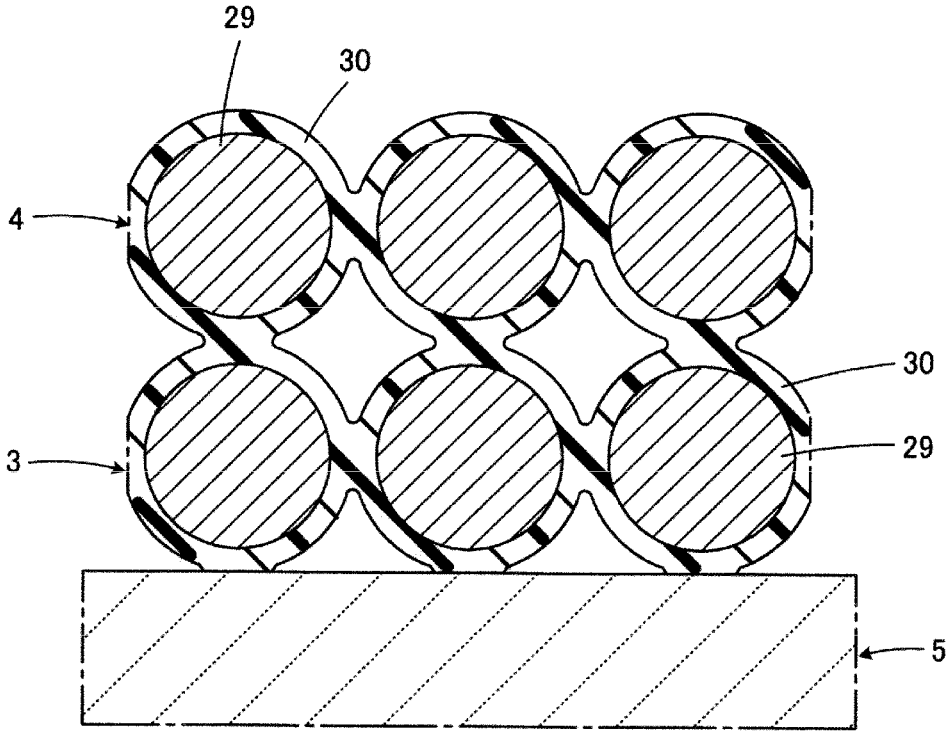
FIG. 20 is an enlarged schematic sectional view of a coil component according to a third embodiment and illustrates a state where the first wire and the second wire are secured.

In FIG. 20, the first wire 3 and the second wire 4 are fusion-bonded to each other to make the winding state stable. More specifically, the insulating film 30 of the first wire 3 and the insulating film 30 of the second wire 4 are fusion-bonded to each other by being heated or pressed, and accordingly, the winding state of the first wire 3 and the second wire 4 is made stable. The insulating film 30 of the first wire 3 and the insulating film 30 of the second wire 4 may be fusion-bonded such that the entire portions in contact with each other are fusion-bonded or parts of the portions in contact with each other are fusion-bonded. In FIG. 20, the first wire 3 and the winding core portion 5 are fusion-bonded to each other. However, the first wire 3 and the winding core portion 5 may not be fusion-bonded to each other.

Figure 21:
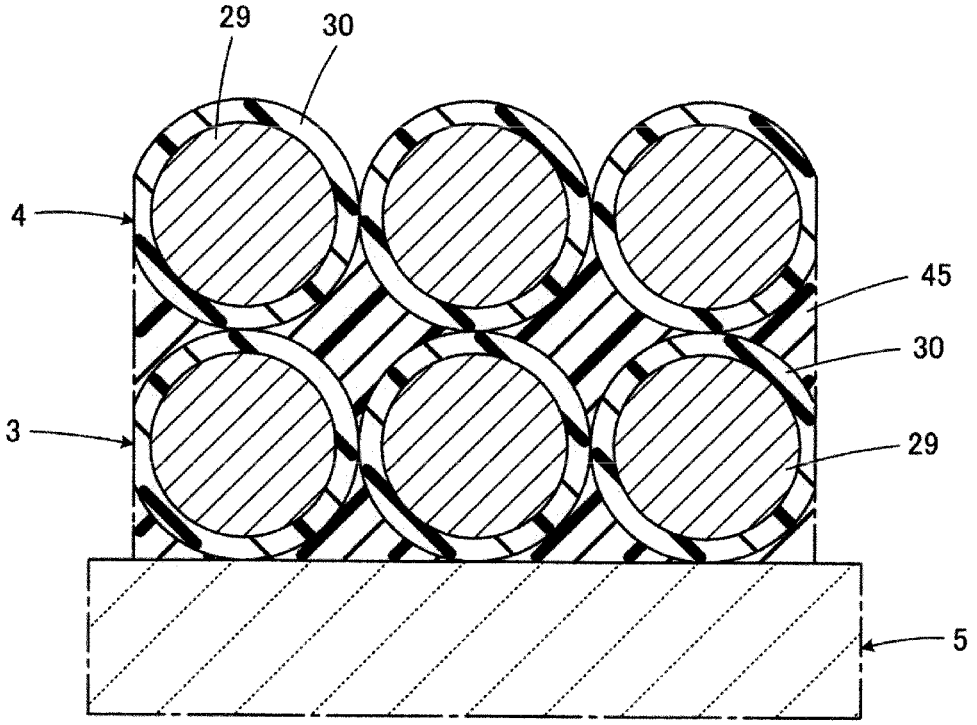
FIG. 21 is an enlarged schematic sectional view of a coil component according to a fourth embodiment and illustrates a state where the first wire and the second wire are secured.

In FIG. 21, a resin 45 is filled between the first wire 3 and the second wire 4 to make the winding state stable. Examples of the resin 45 preferably include a resin having a relatively low dielectric constant such as a polyethylene resin, a fluorine resin, or a polyimide resin. The method of filling the resin 45 is preferable in the perspective of an increase in efficiency with which the coil component is manufactured and a small effect on the electrical insulation.

In FIG. 20 and FIG. 21, the first wire 3 is inside the second wire 4, and the second wire 4 is outside the first wire 3. The positional relationship has no essential meaning and may be reversed.

The method illustrated in FIG. 20 and the method illustrated in FIG. 21 may be combined. At least one of the method illustrated in FIG. 20 and the method illustrated in FIG. 21 may be combined with the above method of using the auxiliary lines.

Paraffin that serves as wax typically adheres to the surface of the first wire and the surface of the second wire to smoothly wind the first wire and the second wire. Accordingly, the position at which the outer wire is wound can be made stable in a manner in which the paraffin is partly removed in a subsequent process such that there is no paraffin on a part of a contact between the first wire and the second wire.

A coil component according to an aspect of the present disclosure is described with the embodiments illustrated. The coil component can have various other embodiments.

For example, although the ratio of the alignment winding region to an entire region in which the wires are wound around the winding core portion is preferably increased, there may be other regions other than the alignment winding region, example of which include a region in which the first wire and the second wire are not wound so as to form the layers, a region in which the first wire and the second wire are alternately wound on the outside even so as to form layers, a region in which the turns of the wire wound on the outside are fitted in the recessed portion formed between the adjacent turns of the wire wound on the inside as with the existing technique, and a region in which an outer turn and an inner turn having different ordinal numbers are aligned with each other.

According to the above embodiments, each coil component forms a common mode choke coil. However, the coil component may form a transformer or a balun.

The embodiments and the modifications are described above by way of example. Features of the different embodiments and modifications may be partially replaced or combined.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a drum-shaped core that includes a winding core portion extending along a central axis, a first flange portion that is disposed on a first end portion of the winding core portion in a direction of the central axis, and a second flange portion that is disposed on a second end portion of the winding core portion in the direction of the central axis;

a first terminal electrode and a third terminal electrode that are disposed on a bottom surface of the first flange portion that is to face a mounting substrate during mounting;

a second terminal electrode and a fourth terminal electrode that are disposed on a bottom surface of the second flange portion that is to face the mounting substrate;

a first wire that is wound around the winding core portion and that is electrically connected to the first terminal electrode and the second terminal electrode;

a second wire that is wound around the winding core portion and that is electrically connected to the third terminal electrode and the fourth terminal electrode;

a first auxiliary line; and a first alignment winding region, the first auxiliary line being a wire having a circular cross-section, that is wound with the first wire and fitted in a recessed portion formed between the adjacent turns of the first wire in the first alignment winding region; and in the first alignment winding region, the second wire being continuously wound so as to have turns such that the turns of the second wire are aligned, by the first auxiliary line, with turns of the first wire having a same ordinal number outside the first wire in a direction perpendicular to the central axis, the ordinal number being counted from the turn nearest to the first flange portion.

2. The coil component according to claim 1, wherein the first auxiliary line contains a resin.

3. The coil component according to claim 2, wherein the first auxiliary line contains a polyethylene resin, a fluorine resin, or a polyimide resin.

4. The coil component according to claim 2, wherein a first end of the first auxiliary line is secured to the drum-shaped core.

5. The coil component according to claim 4, wherein each of the first flange portion and the second flange portion has an inner end surface, an outer end surface, a first side surface, and a second side surface that extend in a direction perpendicular to the bottom surface, the inner end surface faces in an inward direction toward the winding core portion, the outer end surface faces away from the inner end surface in an outward direction, the first side surface and the second side surface do not face in the inward direction or the outward direction but face away from each other in a side direction, and the first end of the first auxiliary line is secured to the first side surface or the second side surface of the first flange portion or the second flange portion.

6. The coil component according to claim 1, further comprising:

an auxiliary electrode that is disposed on a surface of the drum-shaped core, wherein the first auxiliary line includes a linear, central conductor and an insulating film that is composed of an electrical-insulation resin and that covers a circumferential surface of the central conductor, and a first end of the first auxiliary line is connected to the auxiliary electrode.

7. The coil component according to claim 6, wherein the auxiliary electrode is disposed on a surface of the first flange portion other than the bottom surface or a surface of the second flange portion other than the bottom surface.

8. The coil component according to claim 1, further comprising:

a second alignment winding region in which the first wire is continuously wound so as to have turns such that the turns of the first wire are aligned with turns of the second wire having a same ordinal number outside the second wire in the direction perpendicular to the central axis, the ordinal number being counted from the turn nearest to the first flange portion, the second alignment winding region being nearer than the first alignment winding region to the second flange portion.

9. The coil component according to claim 8, further comprising:

a second auxiliary line that is fitted in a recessed portion formed between the adjacent turns of the second wire in the second alignment winding region.

10. The coil component according to claim 9, wherein the second auxiliary line extends from a winding end nearer than the other winding end to the first flange portion toward the first flange portion.

11. The coil component according to claim 9, wherein the second auxiliary line extends from a winding end nearer than the other winding end to the first flange portion toward the second flange portion.

12. The coil component according to claim 9, wherein the winding end of the second auxiliary line nearer than the other winding end to the first flange portion is near an upper surface opposite the bottom surface.

13. The coil component according to claim 1, wherein a dimension of the winding core portion in a width direction that is parallel to the bottom surface and that is perpendicular to the central axis is equal to or less than 40% of a dimension of the first flange portion.

14. The coil component according to claim 1, wherein the first wire and the second wire are fusion-bonded to each other.

15. The coil component according to claim 1, further comprising:

a resin that is filled between the first wire and the second wire.

16. The coil component according to claim 3, wherein a first end of the first auxiliary line is secured to the drum-shaped core.

17. A coil component comprising:

a drum-shaped core that includes a winding core portion extending along a central axis, a first flange portion that is disposed on a first end portion of the winding core portion in a direction of the central axis, and a second flange portion that is disposed on a second end portion of the winding core portion in the direction of the central axis;

a first terminal electrode and a third terminal electrode that are disposed on a bottom surface of the first flange portion that is to face a mounting substrate during mounting;

a second terminal electrode and a fourth terminal electrode that are disposed on a bottom surface of the second flange portion that is to face the mounting substrate;

a first wire that is wound around the winding core portion and that is electrically connected to the first terminal electrode and the second terminal electrode;

a second wire that is wound around the winding core portion and that is electrically connected to the third terminal electrode and the fourth terminal electrode;

a first auxiliary line; and a first alignment winding region, wherein the first auxiliary line is fitted in a recessed portion formed between the adjacent turns of the first wire in the first alignment winding region; and in the first alignment winding region, in which the second wire is continuously wound so as to have turns such that the turns of the second wire are aligned with turns of the first wire having a same ordinal number outside the first wire in a direction perpendicular to the central axis, the ordinal number being counted from the turn nearest to the first flange portion, wherein the first wire, the second wire, and the first auxiliary line have a circular section and satisfy $0.16\ R \leq r \leq R$, where R is a diameter of the section of the first wire and the section of the second wire, and r is a diameter of the section of the first auxiliary line.

18. The coil component according to claim 17, wherein the first auxiliary line contains a resin.

* * * * *